US009607629B2

(12) United States Patent
Birkle

(10) Patent No.: US 9,607,629 B2
(45) Date of Patent: Mar. 28, 2017

(54) FREQUENCY RESPONSE DISPLAY

(71) Applicant: Bose Coproration, Framingham, MA (US)

(72) Inventor: Thomas Birkle, Boulder, CO (US)

(73) Assignee: Bose Corporation, Framingham, MA (US)

( * ) Notice: Subject to any disclaimer, the term of this patent is extended or adjusted under 35 U.S.C. 154(b) by 269 days.

(21) Appl. No.: 14/524,102

(22) Filed: Oct. 27, 2014

(65) Prior Publication Data

US 2016/0118058 A1 Apr. 28, 2016

(51) Int. Cl.

| | |
|---|---|
| ***H04R 29/00*** | (2006.01) |
| ***G10L 21/14*** | (2013.01) |
| ***H04S 7/00*** | (2006.01) |

(52) U.S. Cl.
CPC ..... *G10L 21/14* (2013.01); *H04S 7/40* (2013.01)

(58) Field of Classification Search
CPC ..... H04S 7/40; G10L 21/14
USPC ..... 381/56, 58
See application file for complete search history.

(56) References Cited

U.S. PATENT DOCUMENTS

| | | | | |
|---|---|---|---|---|
| 4,782,284 | A | 11/1988 | Adams et al. | |
| 8,023,558 | B2 | 9/2011 | Wasohura | |
| 8,150,051 | B2 * | 4/2012 | Jorgensen | H04S 7/00 381/58 |

* cited by examiner

*Primary Examiner* — Paul S Kim
(74) *Attorney, Agent, or Firm* — Schmeiser, Olsen & Watts LLP

(57) ABSTRACT

A system and method are provided for displaying a frequency response for a sound system design. Coverage map data is processed for a listening area. The coverage map data comprises a plurality of samples. Frequency response data is computed for each sample. The frequency response data is accumulated into a plurality of distributions. A statistical frequency response display is generated based on the distributions.

16 Claims, 8 Drawing Sheets

FREQUENCY RESPONSE DISPLAY

BACKGROUND

This description relates generally to sound system design and simulation, and more specifically, to systems and methods for accumulating a distribution of spectral data corresponding to a listening area, and displaying a statistical frequency response from the consolidated spectral data.

BRIEF SUMMARY

In accordance with one aspect, a method is provided for displaying a frequency response for a sound system design. The method comprises processing coverage map data for a listening area, the coverage map data comprising a plurality of samples; computing frequency response data for each sample; accumulating the frequency response data into a plurality of distributions; and generating a statistical frequency response display based on the distributions.

Examples may include one or more of the following:

Accumulating the frequency response data into a plurality of distributions may comprise representing each distribution as a histogram comprising a plurality of bins, each bin representing a range of sound pressure levels at a given frequency.

The method may further comprise normalizing the distributions. Normalizing the distributions may comprise identifying a bin of the histogram having a largest value; and dividing all of the bins by the largest value. The largest value may correspond to a highest occurrence of a sound pressure level.

The plurality of samples of the coverage map may correspond to locations of a listening area.

The method may further comprise dynamically updating the statistical frequency response display in response to a change in the sound system design.

Accumulating the frequency response data may comprise accumulating a distribution of spectral data at each sample in a coverage map corresponding to the coverage map data.

The statistical frequency response display may represent the probability of achieving a given sound pressure level at a given frequency.

The statistical frequency response display may plot sound pressure level on a y-axis and frequency on a x-axis, and superimpose the probability on the x-axis and the y-axis.

The probability may be shown using colored shading, in which different colors of the colored shading each represents a different probability.

Computing frequency response data may comprise computing a sound pressure level of the sound system relative to a frequency for a predetermined range of frequencies.

In accordance with another aspect, a frequency response processing system comprises a coverage map sampling unit that processes a plurality of samples from a set of coverage map data and computes frequency response data for each sample; a statistics buffer that accumulates the frequency response data into a plurality of distributions; and a frequency response generator that generates a statistical frequency response display based on the distributions.

Examples may include one or more of the following:

The statistics buffer may represent each distribution as a histogram comprising a plurality of bins, each bin representing a range of sound pressure levels at a given frequency.

The frequency response processing system may further comprise a normalizer that normalizes the distributions by identifying a bin of the histogram having a largest value and dividing all of the bins by the largest value.

The largest value may correspond to a highest occurrence of a sound pressure level.

The statistics buffer may accumulate a distribution of spectral data at each sample in a coverage map corresponding to the coverage map data.

The statistical frequency response display may plot a sound pressure level on a y-axis and a frequency on a x-axis, and superimpose the probability of achieving the sound pressure level at the frequency on the x-axis and the y-axis.

In accordance with another aspect, an audio simulation system comprises an input for receiving data for a sound system and a listening area; a coverage map processor configured to generate a coverage map data set from the data for the sound system and listening area; a frequency response processor configured to process the coverage map data and generate statistical frequency response data from the coverage map data; and a display that displays the statistical frequency response data.

The frequency response processor may compute a sound pressure level of the sound system relative to a frequency for a predetermined range of frequencies.

The display may plot a sound pressure level on a y-axis and a frequency on an x-axis, and superimpose a probability of achieving the sound pressure level at the frequency on the x-axis and the y-axis. The probability may be shown using colored shading, in which different colors of the colored shading each represents a different probability.

The statistical frequency response data may be dynamically updated in response to a change in the sound system.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

A number of implementations have been described. Nevertheless, it will be understood that the foregoing description is intended to illustrate and not to limit the scope of the inventive concepts which is defined by the scope of the claims. Other examples are within the scope of the following claims.

Prediction of sound system performance may involve the computation of coverage maps of a listening area, which provide insight to the spatial behavior for a sound system by displaying the direct field sound pressure levels throughout the listening area as a spectrum of colors. To further predict and evaluate sound system performance, a displayed frequency response can be shown of a spectral performance (i.e., to show how sound pressure level varies over a band of frequencies) at a single location of the listening area. However, neither the coverage maps nor the conventional frequency response displays provide a comprehensive understanding of the frequency response throughout the listening area, referred to as a statistical frequency response.

Examples of the present inventive concepts provide a system and method for bridging the information displayed in a coverage map and a frequency response display by consolidating the frequency responses for a number of sample points in the coverage map into a single display. In particular, spectral statistics corresponding to a listening area and/or audio component such as an amplifier or a loudspeaker are consolidated into a summary display.

Figure 1:
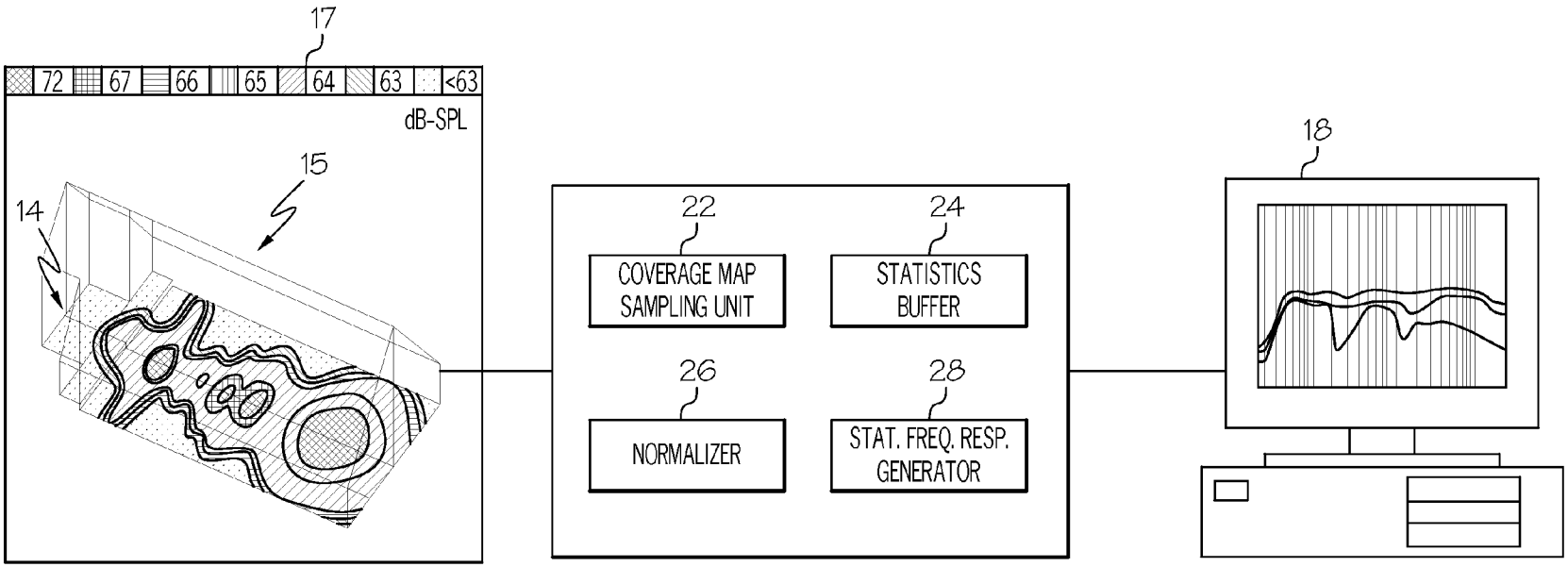
FIG. 1 is a diagrammatic view of a frequency response processing system between a coverage map data set and a display, in accordance with some examples.

FIG. 1 is a diagrammatic view of a frequency response processing system 16, a coverage map data set 14 and a display 18, in accordance with some examples. As will be described further, the frequency response processing system 16 computes a frequency response at each sample point on a coverage map, for example, a $1/50^{th}$ octave frequency response (see, e.g., an example of a frequency response in FIG. 2), and accumulates the frequency response data into distributions that cover a predetermined listening area range, e.g., 20-120 db-SPL (sound pressure level) at the listening area 15, which in the example shown in FIG. 1 corresponds to the seating area in the nave of a church. The accumulated frequency response data can be output as a single statistical frequency response display (see FIG. 6).

The coverage map data set 14 is generated by a coverage map processor, and stored in a memory device adapted to store contents of one or more direct field coverage maps, which may be generated by an acoustic design system, simulator, modeling software (such as Bose® Modeler®), or related systems known to those of ordinary skill in the art for generating coverage maps to predict and evaluate the quality of sound in a room or related listening environment. As is well-known, a coverage map shows the direct field sound pressure levels throughout the listening area as a spectrum of colors. A key 17 is provided that associates sound pressure levels with various colors. The sound pressure levels can be shown on a spatial grid or mesh with respect to a listening audience area where sound system performance is predicted. The direct field energy can be estimated based on sound pressure level (SPL) at a location generated by the direct signal from the sound system or related device under test in a modeled venue. The frequency response processing system 16 comprises a coverage map sampling unit 22, a statistics buffer 24, a normalizer 26, and a statistics frequency response generator 28.

Figure 2:
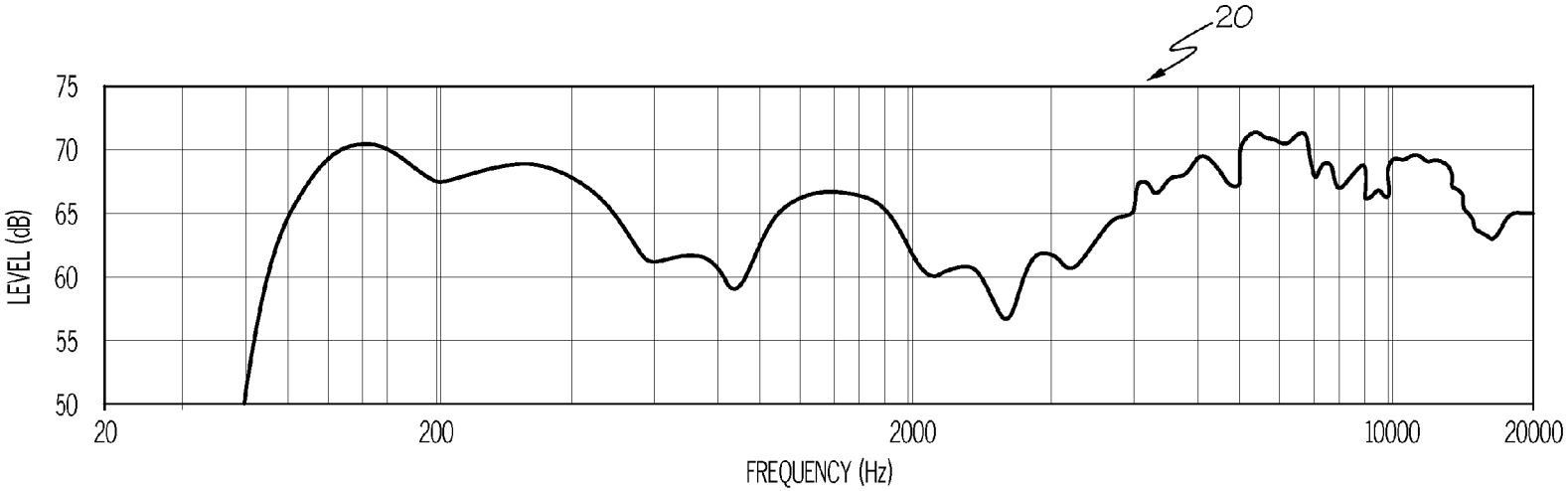
FIG. 2 is a graph of a frequency response at a sample point on a coverage map.

The coverage map sampling unit 22 receives and processes data from a coverage map data set and generates a frequency response for a number of sample points on the coverage map 14. The number of sample points is set by the coverage map resolution. For each sample point, the coverage map sampling unit 22 generates a frequency response by calculating sound pressure level over a band of frequencies, for example, 20 to 20,000 Hz (though other ranges may be used). A frequency response thus represents the spectral content at each sample point on the coverage map, and predicts how sound pressure level changes over a band of frequencies at a particular point on the coverage map. An example frequency response for a particular sample point of a listening area is shown in FIG. 2. The coverage map sampling unit 22 can communicate with, or be part of, a sound system design system that predicts and evaluates the quality of sound in a room, for example, a Bose® Modeler® system, or other sound system design tools, simulators and/or modeling software known to those of ordinary skill in the art. Such a design system, simulator and/or modeling software can be modified in accordance with the inventive concepts, for example, described herein.

The statistics buffer 24 stores statistical data associated with the frequency responses generated by the coverage map sampling unit 22. To generate the statistical data, the frequency response data is accumulated into a number of distributions representing the probability of a particular sound pressure level at a given frequency. For example, at a given frequency in each frequency response generated by the coverage map sampling unit 22, the probability that the sound system will achieve a given sound pressure level is calculated, and stored as a distribution. A distribution is generated for each frequency of interest (which can vary depending on the desired frequency resolution). The distributions can be represented as histograms or the like, with each histogram including one or more discrete intervals, or bins, representing a range of sound pressure levels. In one example, each histogram bin can be 1 dB wide, and the entire distribution can span from 20 to 120 db-SPL, though other bin sizes and ranges can be used. To accumulate the frequency response data, for each frequency of interest in the frequency responses, the bin value that corresponds to the calculated sound pressure level for that frequency is incremented by 1. By way of example, if the sound pressure level at 1,000 Hz is 74 db-SPL in one frequency response, the bin value corresponding to 74 db-SPL in the 1,000 Hz distribution is incremented by 1. In this example, to generate the rest of the 1,000 Hz distribution, this process is repeated for each of the frequency responses generated by the coverage map sampling unit 22. Distributions for the other frequencies of interest can be generated using this process as well.

The normalizer 26 normalizes each of the distributions in the statistics buffer 24. A distribution is normalized by identifying a bin of the histogram with the largest value and dividing all of the bins by this value. Each histogram bin value is therefore converted to a normalized value between 0 and 1. The histogram can subsequently be shaded using colors that correspond to the bin values, and represent the probability of SPLs.

Figure 3:
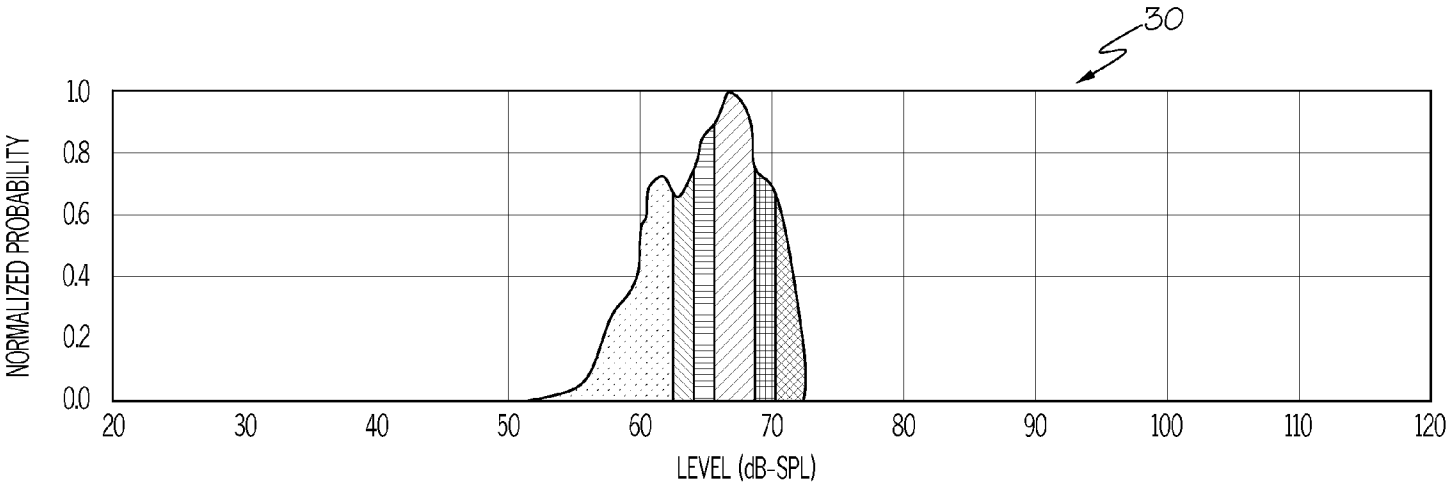
FIG. 3 is a graph of an accumulation of a distribution of spectral data at a plurality of sample points on a coverage map, in accordance with some examples.

For example, FIG. 3 is a graph of an accumulation of a normalized distribution of spectral data at a plurality of sample points on a coverage map, in accordance with some examples. As shown in FIG. 3, a peak (1.0) corresponds to SPL=70, which is a bin of a first color, e.g., green. A higher SPL, e.g., SPL=72 is a different color, e.g., red. A lower SPL, e.g., SPL=63 is yet a different color, e.g., blue. Accordingly, the displayed colors represent different probabilities in the frequency response display of FIG. 3.

The statistics frequency response generator 28 draws each histogram in the statistics buffer 24 according to the foregoing processing by the normalizer 26 and consolidates the distributions onto the display 18, permitting a user to see anomalous data and gauge system performance. As will be described further below, the consolidated display effectively maps the probability of achieving a given sound pressure level on a frequency response graph, showing probability superimposed on an SPL versus frequency graph. The histograms can be drawn according to a method 220 described further below with reference to FIG. 5. The data can be accumulated for all listening locations producing normalized distributions that display frequency responses. This can occur with a low rate of incidence. For example, a design may include a majority of flat frequency responses, and a limited number of poor frequency responses, which are clearly visible in the display. Here, the poor frequency responses have a low probability which can be distinguished from desirable or flat frequency responses by assigning different colors for the frequency responses having the low probability. The data can be organized as amplitude versus frequency, permitting a user to read the displayed statistical frequency response display in a manner similar to a conventional frequency response curve corresponding to a single location sample point of a listening area, as illustrated in FIGS. 2 and 6, respectively.

Figure 4:
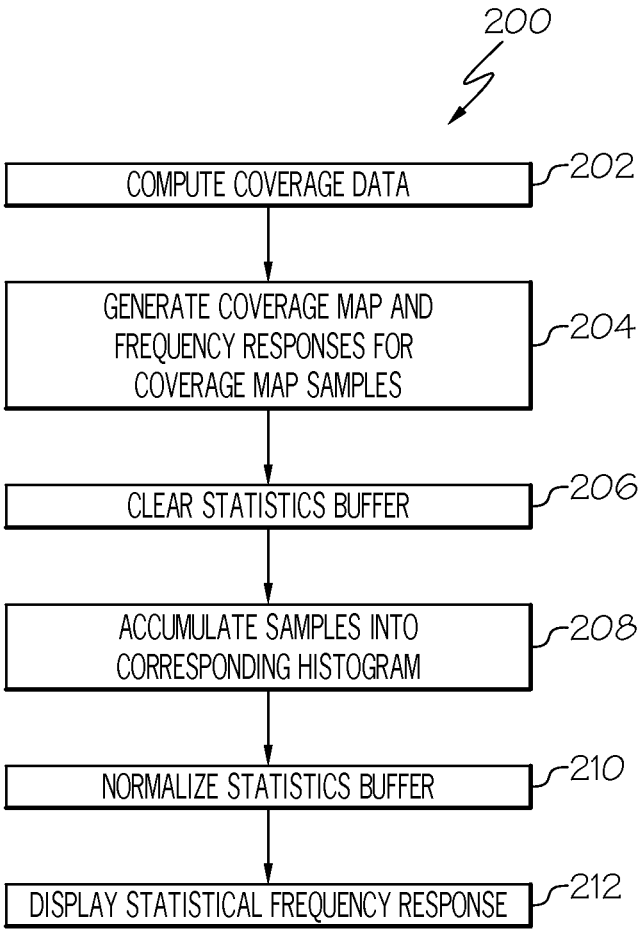
FIG. 4 is a flowchart of a method for displaying a statistical frequency response, in accordance with some examples.

FIG. 4 is a flowchart of a method 200 for displaying a statistical frequency response, in accordance with some examples. In describing the method 200, reference is made to the frequency response processing system 16 of FIG. 1. The method 200 can be implemented in connection with a simulation system or the like used for sound system design.

At block 202, coverage data, for example, coverage map samples, are computed for a listening area of interest. Coverage map samples comprise calculating the direct field sound pressure level at each point of interest in a listening area. New coverage data can be computed each time a change is made to the sound system design. The samples can be taken on a spatial grid or mesh that represents a defined listening area. The samples are used to predict the direct field coverage of one or more loudspeakers over the listening area.

At block 204, a direct field coverage map 14 is generated and stored in a storage device, for example, at coverage map sampling unit 22 (see FIG. 1). In addition, frequency responses are generated from the spectral content of the samples, over the entire audio frequency range, ranging from about 20 Hz to 20,000 Hz. A frequency response may have up to 500 samples, or more, which are uniformly spaced in log (frequency). The coverage map may provide predicted SPLs, for example, viewed at ⅓ octave band frequencies.

For example, as shown in FIG. 2, for each sample point, or location, on the coverage map, a processor can compute a frequency response, for example, a $1/50^{th}$ octave frequency response. A range of dB SPLs can be displayed on the vertical axis of the graph, and the frequency range can be displayed on the horizontal axis of the graph. The frequency responses can be generated by, for example, coverage map sampling unit 22 (see FIG. 1).

At block 206, the statistics buffer 24 is cleared, or zero-filled, prior to the statistics buffer 24 storing the distributions associated with the frequency responses generated by the coverage map sampling unit 22.

At block 208, each sample in the frequency responses is accumulated into a corresponding histogram. As shown in FIG. 3 and described above, a sound system design system can produce a histogram for each frequency sample point, indicating a distribution of SPLs for that frequency. A plot of the normalized probability of a particular SPL is displayed on the vertical axis, and an SPL value is displayed on the horizontal axis. As shown in FIG. 3, each histogram has a set of bins ranging from 20-120 dB SPL. In this example, each histogram bin is 1 dB wide, although the bin width is not limited thereto. Accordingly, each sample from which the histogram is derived can be constructed and arranged for display as a rectangular tessellation, dimensioned as 1 dB by $1/50^{th}$ octave. The frequency response data can be accumulated into a plurality of distributions, with each distribution corresponding to a different frequency, for example, 500 distributions at $1/50^{th}$ octave that covers a range of 20-120 dB-SPL.

As described above, the value of a frequency response sample is accumulated by adding 1 to the histogram bin that corresponds to the sample value. For example, if the frequency value at 1,000 Hz is 74 dB-SPL, then the storage region corresponding to 74 dB-SPL (in the 1,000 Hz histogram) is incremented by one. This process is repeated for each of the frequency response samples, and for each of the frequencies of interest.

At block 210, each of the histograms in the statistics buffer is normalized by identifying the bin in the histogram with the largest value and dividing all of the bin values by this value. Accordingly, the bin corresponding to the normalized value, or highest occurrence, of the relevant SPL, has a value of 1, while the other normalized bin values each ranges from 0 to 1. The histograms can be normalized by, for example, normalizer 26 (see FIG. 1).

At block 212, a statistical frequency response is displayed. In particular, the statistical frequency response display consolidates the spectral statistics from the entire listening area into a summary display, for example, as shown in FIG. 6.

As described above, new coverage data is computed each time a user makes changes to the sound system design. Accordingly, the statistical frequency response is recomputed and redrawn when new coverage data is computed, or when the user selects the statistical frequency response view in the sound system design system. Here, the statistical frequency response is displayed by drawing each of the histograms in the statistics buffer on a graph, such as that shown in FIG. 6. A given histogram can have a rectangular extent that is centered at its corresponding frequency, and spans the SPL bins of the histogram. In some examples, a statistical frequency response display is produced by generating statistics data that persist so long as the system design remains unchanged, then displaying the statistical frequency response as the user interacts with the design system. Example statistical frequency response displays are shown in FIGS. 6-10.

Figure 5:
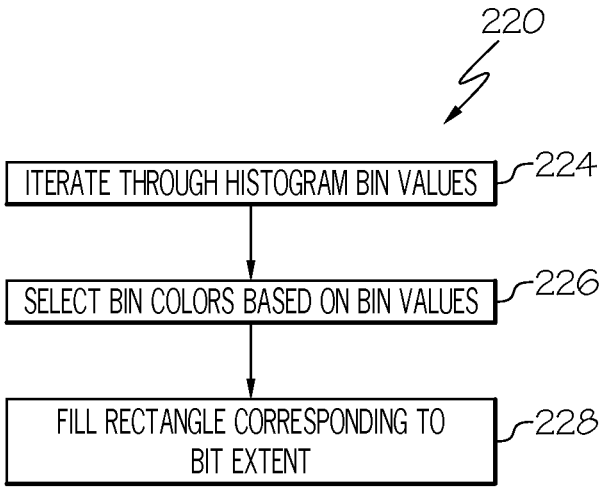
FIG. 5 is a flowchart of a method for drawing a histogram in a statistics buffer for generating a statistical frequency response, in accordance with some examples.
Figure 6:
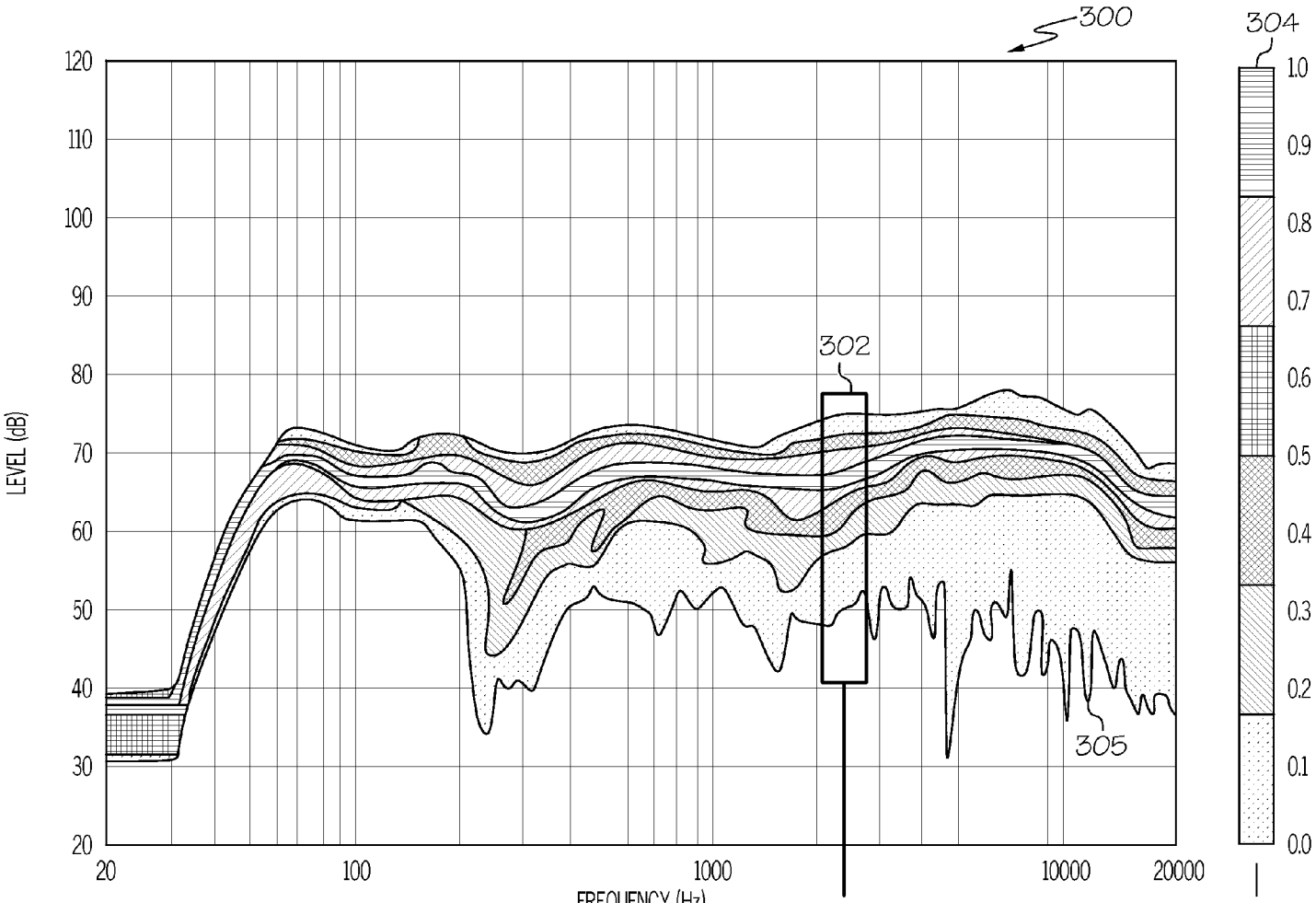
FIG. 6 is a view of a statistical frequency response display, in accordance with some examples.

FIG. 5 is a flowchart of a method 220 for displaying a statistical frequency response, in accordance with some examples. In describing the method 220, reference is made to the frequency response processing system 16 of FIG. 1 and the method 200 described in FIG. 4. Prior to performing the method 220, the histograms in the statistics buffer are normalized, for example, according to block 210 described above. In general, as shown in FIG. 6, each histogram in the statistics buffer is represented as a slice and/or rectangle at its corresponding frequency along the x-axis of a graph, and the range of expected SPLs at that frequency are represented by the height of the slice and/or rectangle along the y-axis, with the probability of achieving a given SPL represented by a range of colors superimposed on the x-axis and the y-axis.

At block 224, the processor iterates through the histogram bin values. A color is selected for each bin based on the corresponding bin value, which in turn corresponds to a probability of achieving a given sound pressure level.

At block 226, in response to the iteration performed at block 224, a color, pattern, or the like is selected for each bin. A color indicating a normalized probability is determined for each bin according to a color scale, for example, color scale 304 shown in FIG. 6.

At block 228, the rectangle corresponding to each bin extent is filled with the color, pattern, or the like selected according to the bin value. In particular, the rectangle corresponding to the bin extent centered at the corresponding frequency, for example, along the x-axis of the histogram, is filled with the selected color for display.

As shown in FIG. 6, a statistical frequency response 300 can be displayed as a map of probability or related graphical representation of a distribution of statistical frequency response data superimposed on an amplitude vs. frequency graph. The probability data is divided into a number of frequency slices, for example, 500 frequency slices. An example of a frequency slice of probability data is inside box 302. The samples in FIG. 6 are displayed as rectangular tessellations, or 1 dB by $1/50^{th}$ octave in extent, but not limited thereto. Sample colors 304 indicate the normalized probability of achieving a given sound pressure level (represented on the y-axis) at a given frequency (represented on the x-axis). For example, data corresponding to sample colors identified as a normalized probability less than 0.3 shown on the color scale 304 represents a low incidence of occurrence deviation with respect to a desirable flat response.

An example of an anomaly can refer to a deviation from a particular frequency response. For example, a number of desirable flat frequency responses are shown in FIG. 6 by brighter colors, for example, ranging from 0.8-1.0 on the color scale 304. Anomalous data can include a number of poor frequency responses that are also are shown in the display as deviating from the flat frequency responses, and identified by colors corresponding to probability values less than 0.3 on the color scale 304.

Accordingly, a feature of a statistical frequency response display is that a user can assess anomalies in loudspeaker coverage. FIGS. 7-10 are coverage maps and corresponding statistical frequency response displays, in accordance with some examples, to illustrate how the statistical frequency response display can be used to identify anomalies in loudspeaker coverage.

Figure 7:
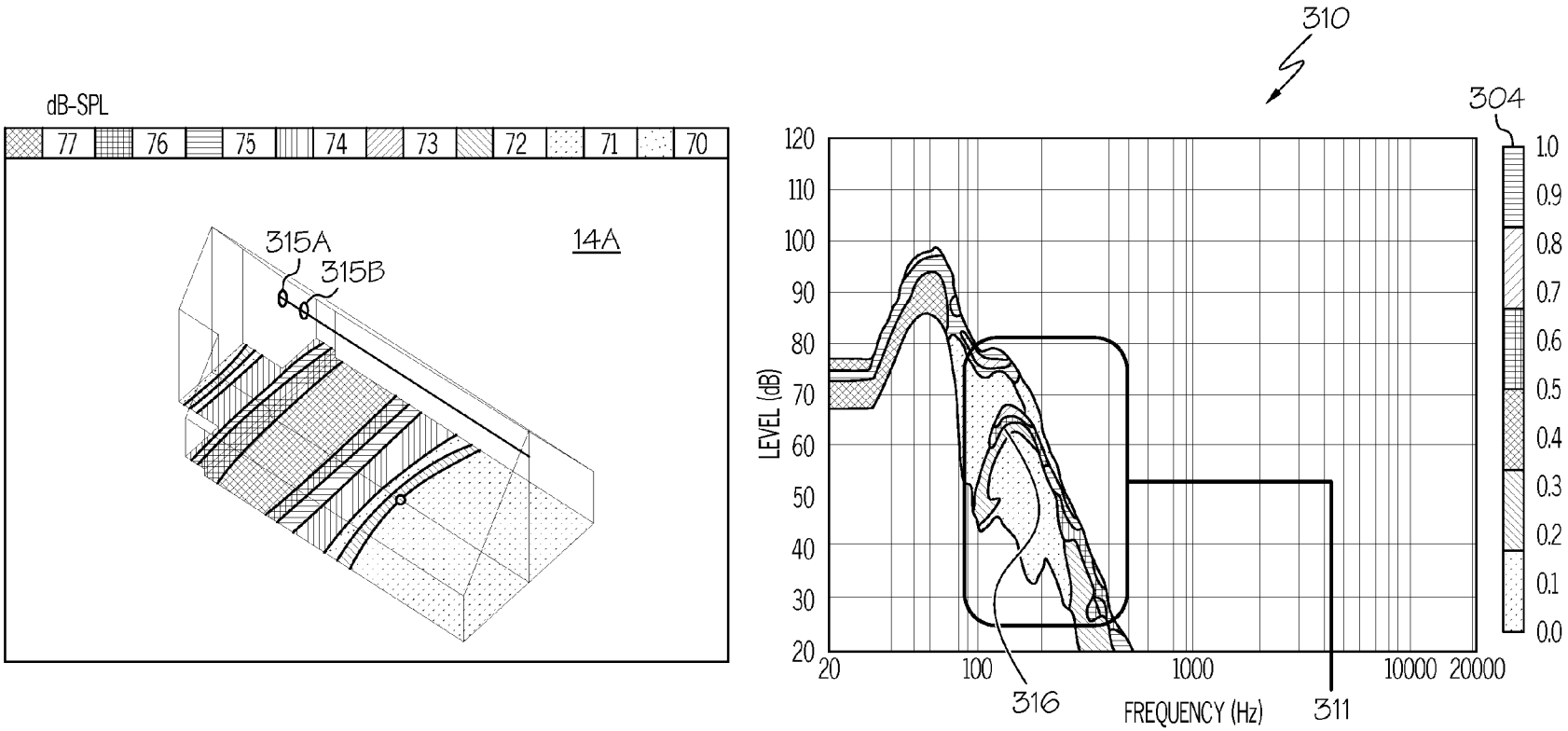
FIGS. 7-10 are views of coverage maps and corresponding statistical frequency response displays, in accordance with some examples.

In FIG. 7, a coverage map 14A is shown for two loudspeaker devices 315A, B of a simulation model or the like spaced a predetermined distance from each other in a defined listening environment. In one example, bass modules may be spaced 2 m apart in a listening area. A statistical frequency response display 310 illustrates the effects of the spacing of the audio devices, and displays resulting interference superimposed on a low pass filter slope. The statistical frequency response display 310 can identify unwanted interference 316 in the modeled design shown in box 311, e.g., identified by colors corresponding to probability values less than 0.3 on the color scale 304.

Figure 8:
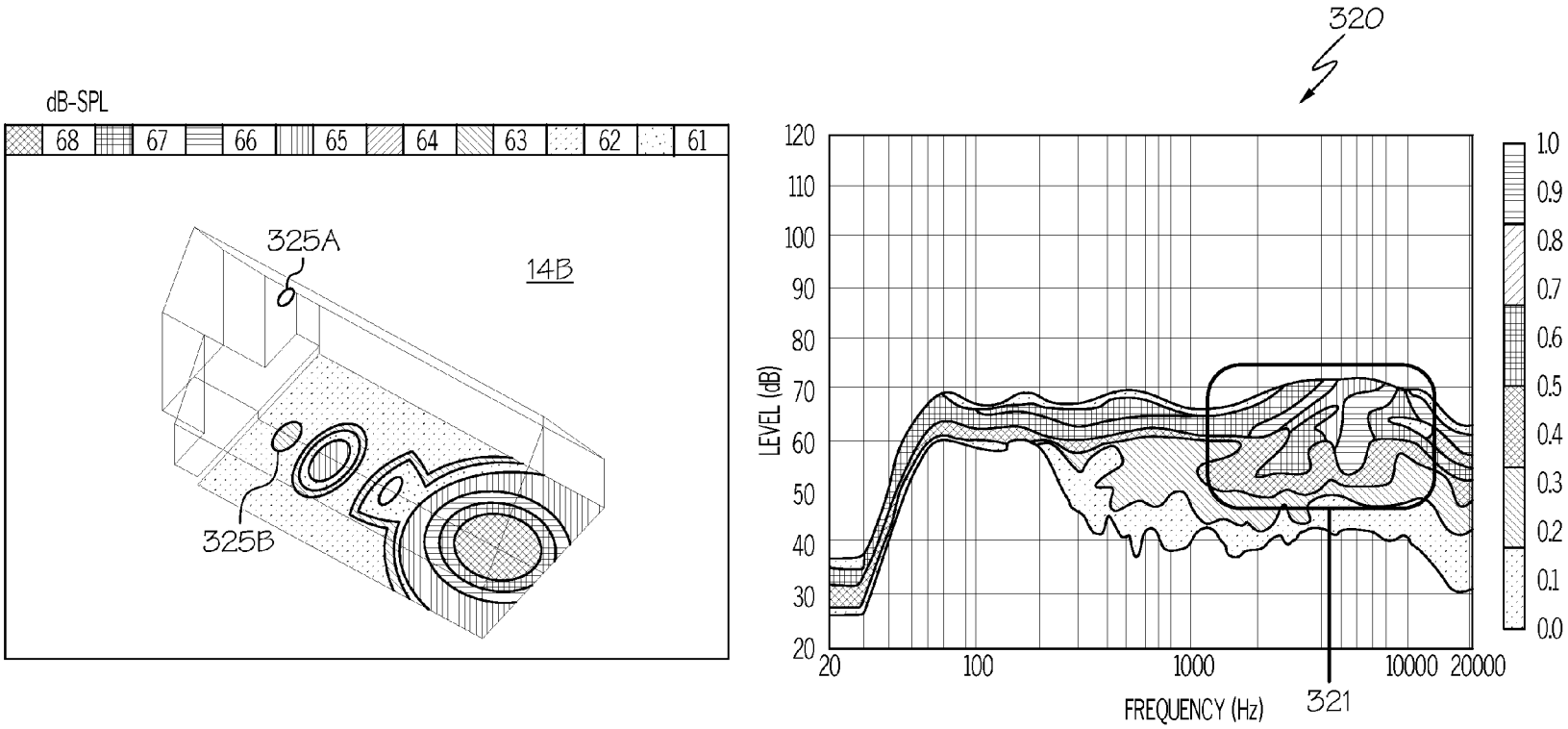

In FIG. 8, a coverage map 14B is shown of top and bottom loudspeaker devices 325A, 325B of an audio array, each device 325A, 325B having a different output power. In one example, the top device 325A has a high frequency output power of 0 dBW and the bottom module has a high frequency output power of 10 dBW. A statistical frequency response display 320 illustrates the effects of the selected gain structure, showing, for example, an unwanted variation in high frequency coverage shown in box 321.

Figure 9:
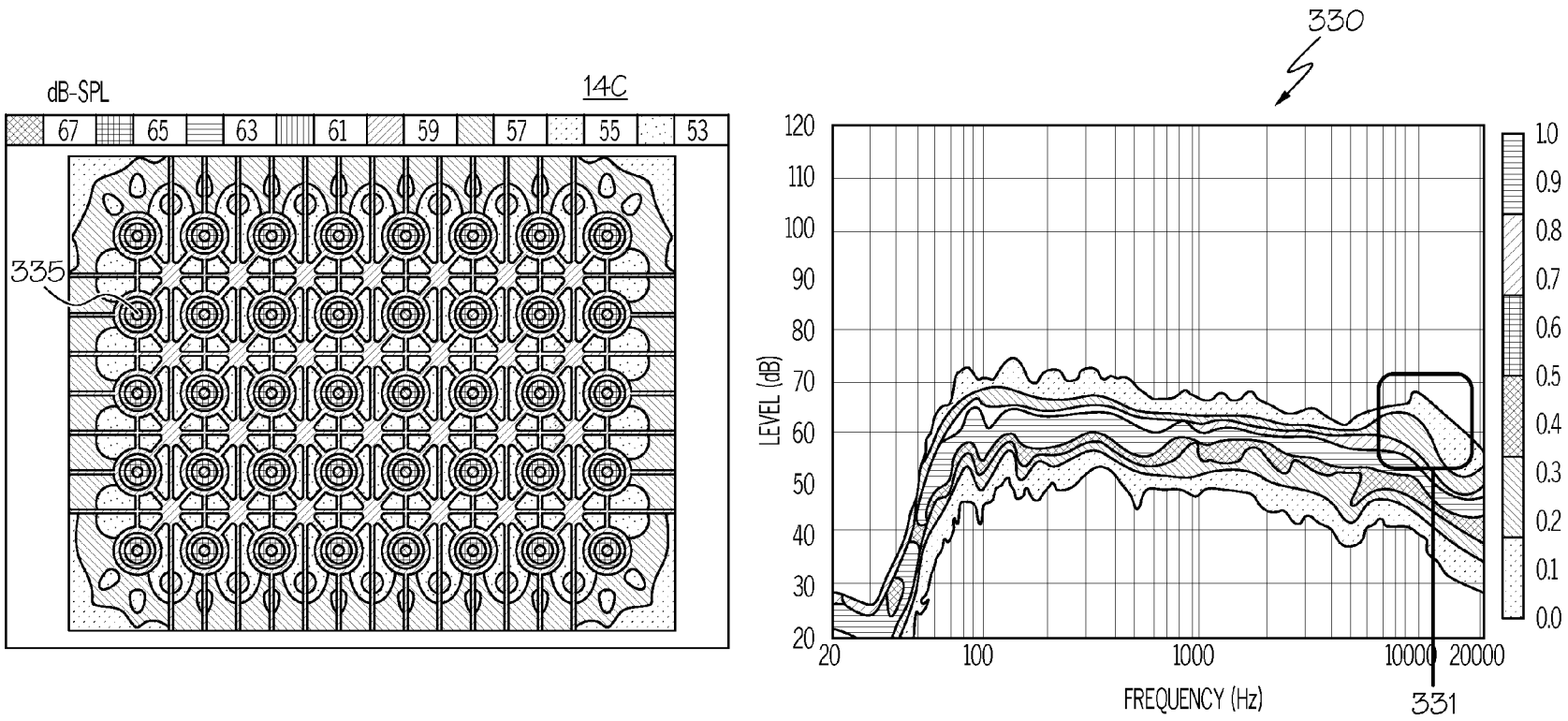

In FIG. 9, a coverage map 14C illustrates a distributed system of a number of loudspeaker devices 335 spaced at regular intervals throughout a defined listening environment. A statistical frequency response display 330 illustrates the effects of high frequency beam narrowing in the distributed system. For example, box 331 surrounds an upward skew showing high frequency beam narrowing in the loudspeakers 335.

Figure 10:
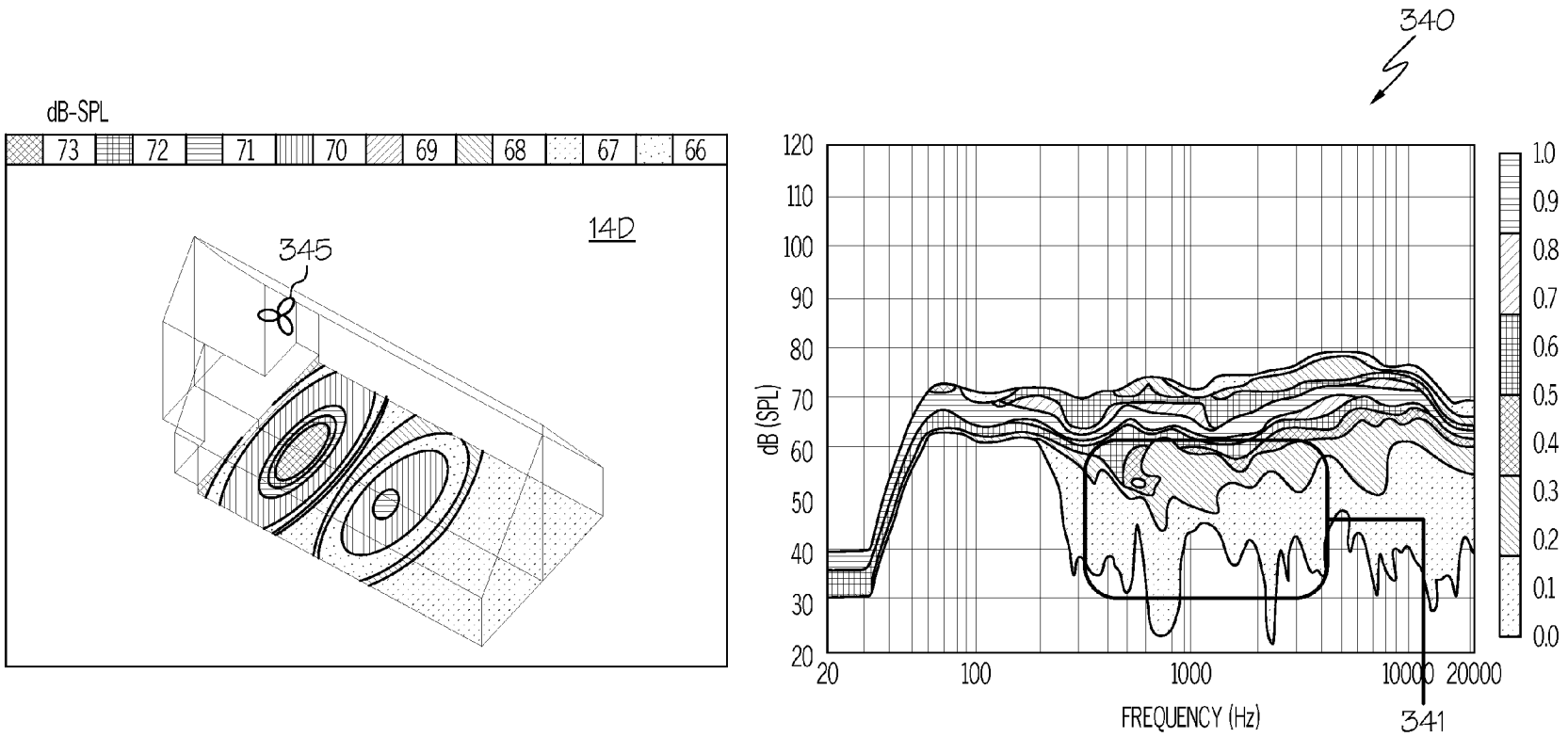

In FIG. 10, a coverage map 14D is shown of a three-module loudspeaker array 345, statistical frequency response display 340 illustrates the effects of inverting one or more of the modules in the array, for example, modules associated with the center array. For example, the display shows downward skew with signs of interference, which is indicative of undesirable module inversion as shown in the region surrounded by box 341.

As described and illustrated herein, a statistical frequency response display permits a user to quickly see anomalous data, and to gauge the effect of a selected sound system design on system performance. In particular, a statistical frequency response display can be constructed and arranged as a navigational tool that identifies anomalies in loudspeaker coverage. It is well-known that conventional sound system design systems can produce coverage maps and frequency response graphs. However, examples of a statistical frequency response system and method provide for the viewing of coverage data and frequency response data of each of a plurality of samples simultaneously. In particular, the statistical frequency response display consolidates spectral statistics for the entire listening area into a summary display. Therefore, a statistical frequency response display can be integrated into a conventional sound system design system user interface which permits simultaneous viewing of coverage maps, a frequency response at any location, coverage statistics, and the statistical frequency response display. The organization of amplitude versus frequency makes it easier to read like a standard frequency response curve. In addition, it enables a sound system designer to view coverage data for the entire listening area in a single display, rather than viewing individual coverage maps for each frequency of interest.

Examples of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, flash ROM, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. A method for displaying a frequency response for a sound system design, comprising:

processing coverage map data for a listening area, the coverage map data comprising a plurality of samples;

computing frequency response data for each sample;

accumulating the frequency response data into a plurality of distributions; and generating a statistical frequency response display based on the distributions, wherein accumulating the frequency response data into a plurality of distributions comprises representing each distribution as a histogram comprising a plurality of bins, each bin representing a range of sound pressure levels at a given frequency.

2. The method of claim 1, further comprising normalizing the distributions.

3. The method of claim 2, wherein normalizing the distributions comprises:

identifying a bin of the histogram having a largest value; and dividing all of the bins by the largest value.

4. The method of claim 3, wherein the largest value corresponds to a highest occurrence of a sound pressure level.

5. The method of claim 1, wherein the plurality of samples of the coverage map correspond to locations of a listening area.

6. The method of claim 1, further comprising dynamically updating the statistical frequency response display in response to a change in the sound system design.

7. The method of claim 1, wherein accumulating the frequency response data comprises accumulating a distribution of spectral data at each sample in a coverage map corresponding to the coverage map data.

8. The method of claim 1, wherein the statistical frequency response display represents the probability of achieving a given sound pressure level at a given frequency.

9. The method of claim 8, wherein the statistical frequency response display plots sound pressure level on a y-axis and frequency on a x-axis, and superimposes the probability on the x-axis and the y-axis.

10. The method of claim 8, wherein the probability is shown using colored shading, in which different colors of the colored shading each represents a different probability.

11. The method of claim 1, wherein computing frequency response data comprises computing a sound pressure level of the sound system relative to a frequency for a predetermined range of frequencies.

12. A frequency response processing system, comprising:

a coverage map sampling unit that processes a plurality of samples from a set of coverage map data and computes frequency response data for each sample;

a statistics buffer that accumulates the frequency response data into a plurality of distributions; and a frequency response generator that generates a statistical frequency response display based on the distributions, wherein the statistics buffer represents each distribution as a histogram comprising a plurality of bins, each bin representing a range of sound pressure levels at a given frequency.

13. The frequency response processing system of claim 12, further comprising a normalizer that normalizes the distributions by identifying a bin of the histogram having a largest value and dividing all of the bins by the largest value.

14. The frequency response processing system of claim 13, wherein the largest value corresponds to a highest occurrence of a sound pressure level.

15. The frequency response processing system of claim 12, wherein the statistics buffer accumulates a distribution of spectral data at each sample in a coverage map corresponding to the coverage map data.

16. The frequency response processing system of claim 12, wherein the statistical frequency response display plots a sound pressure level on a y-axis and a frequency on a x-axis, and superimposes a probability of achieving the sound pressure level at the frequency on the x-axis and the y-axis.

* * * * *